United States Patent [19]

Ford et al.

[11] 4,340,158

[45] Jul. 20, 1982

[54] VENT-SEALING, DOWN-LOCKED PUMP DISPENSER

[75] Inventors: John M. B. Ford, Lee's Summit, Mo.; Wallace F. Magers, Leawood, Kans.; John J. Palmisano, Gladstone, Mo.

[73] Assignee: Realex Corporation, Kansas City, Mo.

[21] Appl. No.: 159,286

[22] Filed: Jun. 13, 1980

[51] Int. Cl.[3] ..... B05B 11/00

[52] U.S. Cl. ..... 222/321; 222/384; 222/481

[58] Field of Search ..... 222/321, 384, 153, 481, 222/482; 239/329, 331, 333

[56] References Cited

U.S. PATENT DOCUMENTS

| | | | |
|---|---|---|---|
| 2,088,790 | 8/1937 | Huthsing | 222/384 X |
| 2,846,124 | 8/1958 | Stewart et al. | 222/384 X |
| 3,237,571 | 3/1966 | Corsette | 222/321 X |
| 4,079,865 | 3/1978 | Kutik | 239/333 X |

*Primary Examiner*—Robert J. Spar
*Assistant Examiner*—Frederick R. Handren
*Attorney, Agent, or Firm*—Schmidt, Johnson, Hovey & Williams

[57] ABSTRACT

The plunger may be locked down after a full depression stroke so that the overall height of the pump assembly and the container with which it is associated can be significantly reduced. A special valve component loosely encircling the plunger and slidable with friction along the interior surface of the barrel is initially positioned during factory assembly in a closed position covering vents in the sidewall of the barrel, thereby blocking the undesirable ingress of liquid into the barrel above the piston should the container be laid on its side during shipment or other handling. Upon the first unlocking upstroke of the plunger to its extended position, a shoulder on the plunger lifts the valve to an open position so the vents can function properly to introduce ambient air into the container replacing pumped-out product. The valve remains stored in its open position until such time as the plunger is once again locked down beyond the limit of its normal depression stroke, this action causing a second shoulder on the plunger to push the valve back down to its closed position.

8 Claims, 6 Drawing Figures

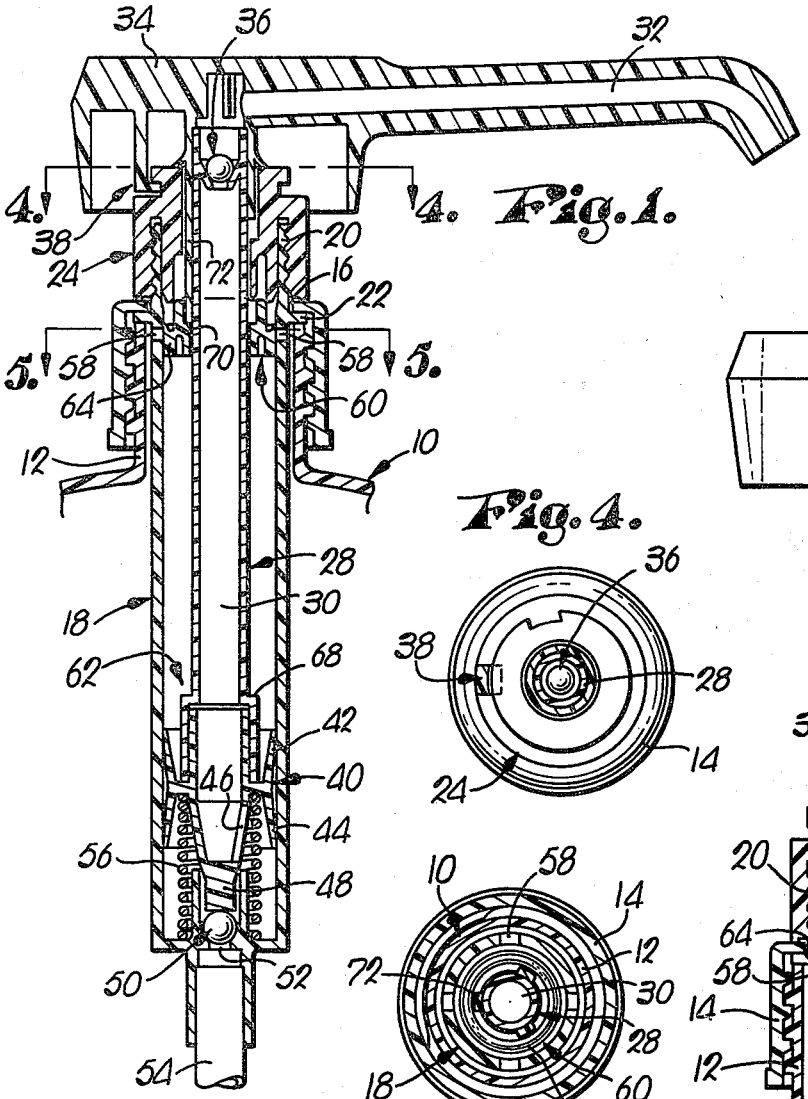
Fig. 1.
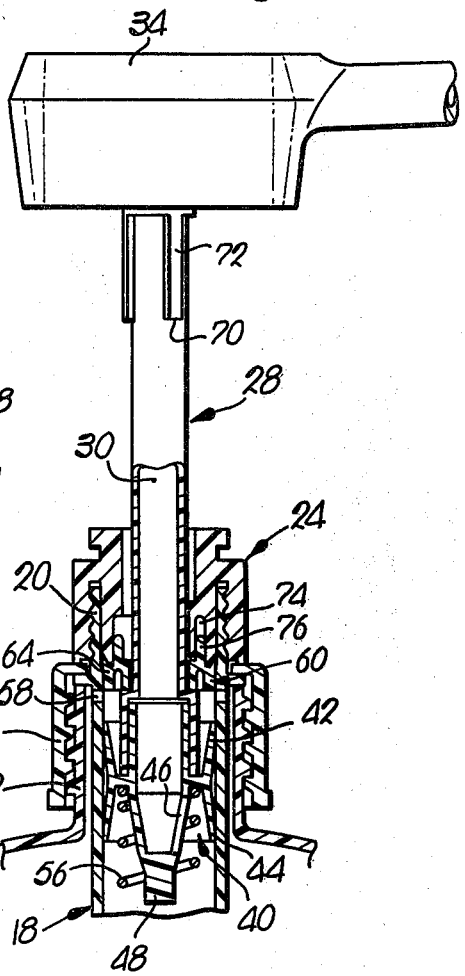
Fig. 2.
Fig. 4.
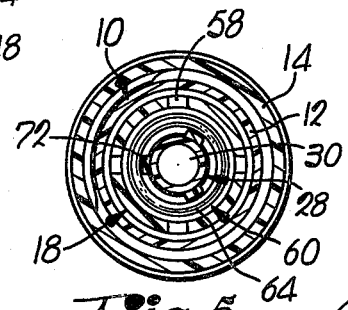
Fig. 5.
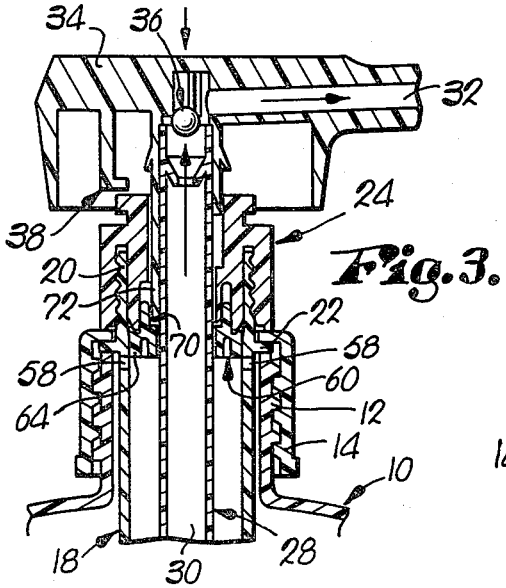
Fig. 3.
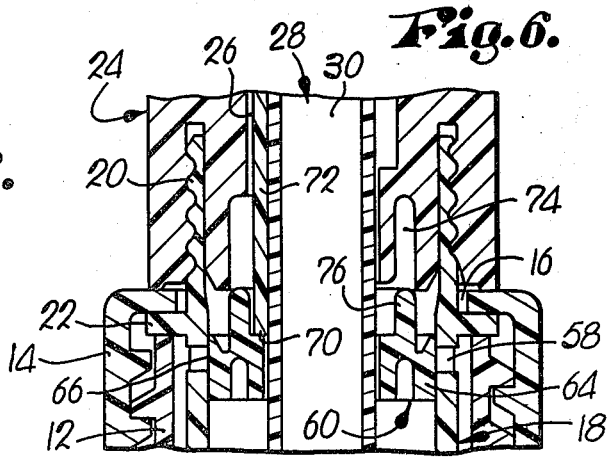
Fig. 6.

VENT-SEALING, DOWN-LOCKED PUMP DISPENSER

TECHNICAL FIELD

This invention relates to hand-operated pump dispensers, and, more particularly, to improvements in that type of dispenser which may be referred to as a "down-position shipper" or a "down-locked" pump.

BACKGROUND ART

It is known in the art to seal off the vent openings in the pump barrel of a so-called "up-position shipper" or "uplocking pump". Since the vent openings are located adjacent the upper end of the barrel, it is a relatively uncomplicated matter for the piston to simply cover the vent openings when the plunger is fully extended and locked in that position. By covering the vent openings in this way, the container may be laid on its side without product entering the barrel through the vent openings and then leaking out the pump around the plunger or otherwise.

But in down-locking pumps the piston is at the lower, opposite end of the barrel when the plunger is in a locked position. Consequently, the piston cannot be used to seal off the vent openings. Thus, then, provides an avenue for product to enter the barrel above the piston and find its way to a leakage path along the plunger or otherwise. Furthermore, product may simply accumulate above the piston so that, on the first upstroke of the plunger after unlocking, the product may be forced up out of the pump along the plunger, producing an unsightly mess.

SUMMARY OF THE INVENTION

In view of the foregoing, an important object of the present invention is to provide a way of sealing off the vent openings in a down-locking pump during the period of time that the plunger is in its fully retracted, down-and-locked position. By the same token, however, it is a further objective to provide for the quick and easy reopening of the vents upon unlocking of the plunger so that proper pumping operations can be effected. Still further, it is an important objective to provide for reclosing of the vents each and every time the plunger is locked down.

In accordance with the present invention and the foregoing objects, the pump barrel is provided with an internal, annular valve component that encircles the plunger in a loose manner yet is in frictional sliding engagement with the interior surface of the barrel. The valve is operable to seal off the vent openings when the valve is placed in covering relationship to such openings. On the other hand, when the valve is shifted away from the openings, the latter are uncovered and are thereby made capable of carrying out their venting functions. Shifting of the valve between its closed and opened positions is accomplished by a pair of axially spaced shoulders on the plunger on opposite sides of the valve with respect to the direction of travel of the plunger. On the first upstroke of the plunger after unlocking, the plunger opens the valve to uncover the vent openings, the valve remaining in a stored or standby position during subsequent operating strokes of the plunger. Upon moving the plunger to its down-and-locked position, a shoulder on the plunger recloses the valve to cover the vent openings.

BRIEF DESCRIPTION OF THE DRAWING

FIG. 1 is a fragmentary vertical cross sectional view of a container-mounted pump dispenser constructed in accordance with the present invention, the plunger being shown in its fully down-and-locked position;

FIG. 2 is a fragmentary, partially elevational and cross sectional view similar to FIG. 1 but with the plunger shown in its fully extended position;

FIG. 3 is a fragmentary vertical cross sectional view similar to FIGS. 1 and 2 but showing the plunger at the inner limit of its normal depression stroke;

FIG. 4 is a fragmentary cross sectional view of the pump taken substantially along line 4—4 of FIG. 1;

FIG. 5 is a fragmentary cross sectional view of the pump taken substantially along line 5—5 of FIG. 1; and FIG. 6 is an enlarged, fragmentary cross sectional view of the pump with the plunger in its down and locked position and the valve component closing off the vent openings of the pump barrel.

DETAILED DESCRIPTION

The pump is designed for attachment to and mounting upon a container such as the container 10 which will normally house a volume of liquid product to be dispensed. Container 10 has an upwardly projecting neck 12 that is externally threaded so as to matingly engage the threads of an internally threaded closure 14 having a centrally disposed hole 16 through which the hollow barrel 18 of the pump may extend. The open upper end 20 of the barrel 18 projects upwardly through the hole 16, while an annular flange 22 of the barrel 18 underlies the portion of closure 14 just outwardly of the hole 16 so that the flange 22 is clamped down against the upper extremity of the container neck 12. In this way the barrel 18 is firmly secured to the container 10.

The pump further includes a collar 24 that fits onto the upper end 20 of the barrel 18 and essentially closes off the latter except for an axial opening 26 that telescopically receives the tubular plunger 28 for reciprocation of the latter within the barrel 18. The plunger 28 includes an internal, axially extending passage 30 communicating at its upper end with an outlet 32 within the actuating head 34 fixed onto the upper end of the plunger 28, a ball-type priming valve 36 being provided adjacent the upper end of the passage 30. A bayonet-type lock 38 is provided between the head 34 and the upper end of the collar 24 for the purpose of releasably holding down the plunger 28 in a locked position. Insofar as the principles of the present invention are concerned, the lock 38 may take several different forms including, for example, a simple threaded-down type of lock.

Adjacent its lower or inner end the plunger 28 carries a piston 40 of tubular construction having a pair of upper and lower, outwardly flaring, frustoconical skirts 42 and 44 which slidingly and sealingly engage the internal surface of the barrel 18. One or more ports 46 in a sidewall of the piston 40 adjacent its lower end communicates the interior of the barrel 18 below the piston 40 with the interior of the piston 40 and the passage 30. A depending protuberance 48 at the lower end of the piston 40 is disposed to somewhat resiliently bear against and hold down a second ball check valve 50 when the plunger 28 is in its down-and-locked position of FIG. 1. The ball check valve 50 controls an inlet 52 at the lower end of the barrel 18 leading from dip tube 54 that is normally immersed within the liquid product to be dispensed. Coil spring 56 between the floor of the barrel 18 and the bottom of the piston 40 yieldably biases the plunger 28 toward an upwardly extended position such as shown in FIG. 2. The spring 56 is optional and has no bearing on the principles of the present invention.

The barrel 18 is provided with vent openings 58 in the sidewall thereof adjacent the upper end 20 but below the flange 22. Such openings 58 are adapted to communicate the interior of the barrel 18 with the interior of the container 10 under appropriate circumstances. In this regard, a special valve 60 is provided within the barrel 18 for opening and closing the vents 58 as determined by structure on the plunger 28 and broadly denoted by the numeral 62.

The valve 60 comprises an annular component 64 that loosely encircles the plunger 28 and slidingly engages the interior surface of the barrel 18 against movement with the plunger 28 at all times excepting those occasions when the structure 62 is brought into operating engagement with the component 64. The radially outermost periphery 66 of the component 64 is disposed to cover and thereby seal the vents 58 when the component 64 is in its closed position as shown in FIGS. 1 and 6. On the other hand, when the component 64 is in its open position shifted upwardly from that of FIG. 1 as shown, for example, in FIGS. 2 and 3, the vents 58 are uncovered and exposed.

The structure 62 includes a pair of axially spaced apart shoulders 68 and 70 located on opposite sides of the component 64 with respect to the direction of travel of the plunger 28. In the illustrated embodiment, the shoulder 68 comprises a continuous annular ledge located slightly upwardly from the piston 40, while the opposite shoulder 70 comprises the lower ends of a plurality of ribs 72 depending from the actuating head 34 and spaced circumferentially about the upper end of the plunger 28. The upper shoulder 70 is disposed to make operating engagement with the upper side of the component 64 while the lower shoulder 68 is disposed to make operating engagement with the lower side thereof.

Because of the frictional interengagement of the component 64 with the barrel 18, the component 64 is adapted to remain held out of its closed position without accidental slippage back to the closed condition. As an assist in augmenting this holding action, however, the lower side of the collar 24 and the upper side of the component 64 are provided with mutually interfitting parts 74 and 76 respectively to frictionally retain the component 64 up against the collar 24 when the component 64 is in its open position.

OPERATION

The plunger 28 is reciprocated in the normal way to provide a pumping action. The two extreme positions of the plunger 28 during such pumping are illustrated in FIGS. 2 and 3, FIG. 2 showing the plunger 28 fully extended and FIG. 3 showing it fully depressed. As will be readily understood by those skilled in the art, during an upstroke, either by action of the return spring 56 or by manually lifting the head 34, the upwardly moving piston 40 induces a negative pressure within the passage 30 and that portion of the barrel 18 below the piston 40 to firmly seat the upper check valve 36 and unseat the lower check valve 50, thereby drawing liquid product into the lower portion of the barrel 18 via the inlet 52. On a subsequent downstroke, positive pressure within the passage 30 and that portion of the barrel 18 below the raised piston 40 reseats the lower check valve 50 and unseats the upper check valve 36 as illustrated in FIG. 3 so that liquid product is forceably discharged from the pump via the outlet 32. After such a downstroke, the plunger 28 may be selectively locked in a position beyond the normal full down position thereof by properly engaging the lock 38 which, as earlier explained, may be of the bayonet-type or a simple threaded-down type of locking arrangement. In such a condition, the protuberance 48 at the lowermost extremity of the plunger 28 engages the lower check valve 50 and holds the same tightly seated to close the inlet 52. In that condition no liquid may enter the plunger 28 via the inlet 52 for leakage from outlet 32 during subsequent handling or shipment.

It is contemplated that during initial assembly of the pump the valve component 64 will be positioned as shown in FIGS. 1 and 6 in covering relationship to the vent openings 58, this constituting the closed position of the component 64. Likewise, the plunger 28 will be in its down-and-locked position of FIGS. 1 and 6 for shipment purposes. Thus, no liquid can enter the plunger 28 via the inlet 52, nor can any liquid enter that portion of the barrel 18 above the piston 40 via the vent openings 58, even if the container 10 should be laid on its side.

After shipment and at the time of first use of the pump, the plunger 28 is unlocked and either biased to its upwardly extended position by the spring 56 or manually drawn to that position by the user, depending upon whether or not the spring 56 is used as aforementioned. As the plunger 28 rises in the barrel 18, the lower shoulder 68 comes into abutting engagement with the bottom side of the valve component 64 as the plunger 28 nears full extension. Over the last increment of such travel, the shoulder 68 shifts the component 64 upwardly along the barrel 18 to its open position of FIG. 2, uncovering the vent openings 58. Friction between the barrel 18 and the component 64, as well as the inter-fitting engagement between the parts 74 and 76, will cause the component 64 to be retained up against the collar 24 during subsequent pumping operations of the plunger 28. With the vent openings 58 thus uncovered, ambient air may be drawn into the container 10 via the collar opening 26 and the annular region between the plunger 28 and the inner periphery of the component 64 during upstrokes of the plunger 28.

It is within the scope of the present invention to leave the component 64 in its open, stored position for all times once displaced out of the factory-set, closed position. With this approach, then, the component 64 would be strictly used during initial shipment as a peak-preventing means.

However, it is also within the concepts of the present invention to provide for reuse of the valve component 64 during each lock down of the plunger 28. In accordance with that approach, the plunger 28 may be provided with the upper shoulder 70 which is disposed to avoid operating engagement with the valve component 64 during normal pumping operations but which is operable to engage and shift the component 64 back to its closed position when the plunger 28 is shifted beyond its fully depressed position to its down-and-locked positions of FIGS. 1 and 6. Shoulder 70 overcomes the retentive friction of the parts 74 and 76, as well as that of the interior surface of the barrel 18, to reclose the vent openings 58 at this time. In this way, the pump is resealed against leakage via the vent openings 58 each and every time the plunger 28 is locked down. This also serves to prevent the accumulation of liquid product in that portion of the barrel 18 above the piston 40 when the plunger 28 is locked down, thereby avoiding the unsightly and otherwise undesirable escape of product up through the collar opening 26 during each initial unlocking upstroke of the plunger 28 after the latter has been locked down.

We claim:

1. In a dispensing pump having a tubular plunger that is reciprocable within a hollow barrel of the pump between extended and depressed positions for drawing liquid into the barrel during extension strokes and for discharging liquid from the barrel during depression strokes, the improvement comprising:

vent means associated with said barrel and adapted to communicate the interior of the latter with the interior of a container with which the pump is operably associated;

lock means operably associated with said plunger for releasably holding the latter in a locked position inwardly beyond said depressed position when the plunger is selectively moved to said locked position; a valve operable within said barrel between an open position exposing said vent means and a closed position sealably covering said vent means and precluding liquid flow into the barrel; and structure operably associated with said plunger for opening said valve during reciprocation of the plunger between said depressed and extended positions, and for closing the valve during holding of the plunger at said locked position.

2. In a dispensing pump having a tubular plunger that is reciprocable within a hollow barrel of the pump between extended and depressed positions for drawing liquid into the barrel during extension strokes and for discharging liquid from the barrel during depression strokes, the improvement comprising:

vent means associated with said barrel and adapted to communicate the interior of the latter with the interior of a container with which the pump is operably associated;

lock means operably associated with said plunger for releasably holding the latter in a locked position inwardly beyond said depressed position when the plunger is selectively moved to said locked position;

a valve operable between open and closed conditions for opening and closing said vent means respectively; and structure operably associated with said plunger for opening said valve during reciprocation of the plunger between said depressed and extended positions, and for closing the valve during holding of the plunger at said locked position, said valve including a component held within said barrel in sliding frictional engagement with the interior surface thereof against movement with said plunger, said structure including a pair of longitudinally spaced shoulders on the plunger on opposite sides of said component with respect to the direction of travel of the plunger in disposition to engage and shift the component in directions for effecting said opening and closing of the valve.

3. In a dispensing pump as claimed in claim 2, wherein said component is provided with an annular configuration and is disposed in circumscribing relationship to said plunger, said component further having a radially outer periphery shiftable into and out of covering relationship with said vent means during closing and opening of the vent means respectively.

4. In a dispensing pump as claimed in claim 3, wherein the pump is further provided with a collar at the outer end of the barrel with respect to the direction of travel of the plunger and through which the plunger reciprocates, said collar and said component having mutually interfitting parts adapted to retain the component in a stored position against the collar until displaced out of the same by operating engagement with an outer one of said shoulders with respect to the direction of plunger travel.

5. In a dispensing pump as claimed in claim 2, wherein the pump is further provided with a collar at the outer end of the barrel with respect to the direction of travel of the plunger and through which the plunger reciprocates, said collar and said component having mutually interfitting parts adapted to retain the component in a stored position against the collar until displaced out of the same by operating engagement with an outer one of said shoulders with respect to the direction of plunger travel.

6. In a dispensing pump having a tubular plunger that is reciprocable within a hollow barrel of the pump between extended and depressed positions for drawing liquid into the barrel during extension strokes and for discharging liquid from the barrel during depression strokes, the improvement comprising:

vent means associated with said barrel and adapted to communicate the interior of the latter with the interior of a container with which the pump is operably associated;

lock means operably associated with said plunger for releasably holding the latter in a locked position inwardly beyond said depressed position when the plunger is selectively moved to said locked position;

a valve sealably closing said vent means in covering relationship therewith to prevent ingress of liquid into the barrel through the vent means from the container when the plunger is at said locked position; and structure for opening said valve out of said covering relationship with the vent means during an initial extension stroke of said plunger, said valve being adapted to remain open during subsequent reciprocation of the plunger between said extended and depressed positions.

7. In a dispensing pump as claimed in claim 6, wherein said structure includes means for reclosing said valve upon movement of the plunger to said locked position.

8. In a dispensing pump having a tubular plunger that is reciprocable within a hollow barrel of the pump between extended and depressed positions for drawing liquid into the barrel during extension strokes and for discharging liquid from the barrel during depression strokes, the improvement comprising:

vent means associated with said barrel and adapted to communicate the interior of the latter with the interior of a container with which the pump is operably associated;

lock means operably associated with said plunger for releasably holding the latter in a locked position inwardly beyond said depressed position when the plunger is selectively moved to said locked position;

a valve closing said vent means to prevent ingress of liquid therethrough from the container when the plunger is at said locked position; and structure for opening said valve during an initial extension stroke of said plunger, said valve being adapted to remain open during subsequent reciprocation of the plunger between said extended and depressed positions, said structure including means for reclosing said valve upon movement of the plunger to said locked position, said valve including an annular component circumscribing said plunger and holdable against movement therewith by sliding frictional engagement with the interior surface of said barrel, said structure including a pair of axially spaced shoulders on said plunger located on opposite sides of said component with respect to the direction of plunger travel in disposition to engage and shift said component in directions causing opening and closing of the valve.

* * * * *